United States Patent [19]

Howard

[11] 4,380,014

[45] Apr. 12, 1983

[54] FEED HORN FOR REFLECTOR ANTENNAE

[75] Inventor: H. Taylor Howard, San Andreas, Calif.

[73] Assignee: Chaparral Communications, Inc., Los Altos, Calif.

[21] Appl. No.: 292,509

[22] Filed: Aug. 13, 1981

[51] Int. Cl.[3] ..... H01Q 13/00

[52] U.S. Cl. ..... 343/786; 343/772

[58] Field of Search ..... 343/772–775, 343/786, 840

[56] References Cited

U.S. PATENT DOCUMENTS 4,112,432 9/1978 Wong et al. ..... 343/786

4,249,183 2/1981 Hai ..... 343/840

*Primary Examiner*—David K. Moore

*Attorney, Agent, or Firm*—F. David LaRiviere

[57] ABSTRACT

An improved feed horn for use with long f/D reflector antennae comprising an aperture having a plurality of protuberances orthogonally disposed around the periphery thereof, a conical section, a waveguide transition section and an impedance matching section.

6 Claims, 6 Drawing Figures

FEED HORN FOR REFLECTOR ANTENNAE

BACKGROUND AND SUMMARY OF THE INVENTION

It is common to employ an electromagnetic feed horn to illuminate a reflector antenna. Desirable performance characteristics are similar for all conical horns having either circular or square apertures used with either parabolic or spherical reflectors.

Such horns typically form the termination of a waveguide transmission system and are thus the final impedance matching component between the waveguide and the reflector. In providing the transition from reflector to waveguide propagation, the feed horn should not overly attenuate, nor introduce excessive noise onto the signal being received or emitted. Signal gain of the horn is determined by the size of its aperture characteristics, while the amount of noise introduced by the horn is partly related to the asymmetry of the radiation patterns in the E- and H-planes.

While the signal illuminating the reflector antenna is typically tapered to provide a good compromise between signal-to-noise ratio and gain, unmodified feed horns have unequal E- and H-plane beamwidths. The unequal beamwidths arise because the E-plane radiation, which tends to "fringe" or bend around the edges of the horn aperture, is larger than the aperture dimension, and the H-plane radiation, which is sinusoidally distributed across the aperture of the horn, is the same as the physical dimension of the horn because no current flows in the walls of the horn.

In the past, E- and H-plane radiation symmetry has been achieved for the special case of vertically polarized excitation by making the aperture of a conical horn rectangular, where the vertical direction is the direction parallel to a short edge of the rectangle, and the H-plane beamwidth is the length of the long edge of the rectangle and substantially equal to the E-plane pattern. However, increasing the H-plane dimension to widen the pattern is not a satisfactory solution because the E-plane radiation continues to fringe and energy is lost along the outside of the horn and because E- and H-phase centers are shifted with respect to each other. Thus well-focused, circularly polarized response from such horns is impossible.

Both rectangular and circular aperture feed horns used with short f/D reflectors, where f is the focal length of the reflector and D is the aperture diameter of the reflector and their ratio is greater than or equal to one, may be easily modified to equalize E- and H-plane radiation by using radially scalar or corrugated structure around the periphery of the aperture. Such corrugation substantially prevents E-field fringing and resultant losses and asymmetry of E- and H-plane beamwidths. However, for the case of long f/D antennae, radially corrugated structures become too large to be practical.

Long f/D antennae are more desirable and becoming more widely used in applications where less discrete focal points are desirable. Such antennae are typically used where the signal sources may be moved or where more than one signal source is to be received by the same antenna. In such applications, it is undesirable to move the entire antenna to receive the signals; rather, it is preferable to move only the feed horn, or, in the case of multiple signal sources, to provide more than one feed horn at a non-discrete focal point.

A feed horn constructed according to the principles of the present invention equalizes E- and H-plane radiation when used with long f/D reflectors and comprises four elements. One element is an aperture, either circular or rectangular, scaled to provide tapered illumination of the reflecting surface. Another element is one-quarter wavelength protuberances symmetrically disposed along the entire periphery of a circular aperture, and along the edges of the rectangular aperture which terminate the E-plane radiation. The diameter and spacing of the protuberances are determined empirically for each aperture. Such protuberances effectively prevent E-plane radiation from fringing and, in practice, substantially equalize the E- and H-plane beamwidths. In addition, the feed horn of the present invention provides a circular waveguide transition from the taper of the conical horn to convert energy flowing down the horn into waveguide propagation mode. Where circular polarization is desired, the waveguide transition section may include field retarding posts. Finally, a feed horn according to the present invention includes an impedance matching section in which circular waveguide energy is provided with suitable impedance matching to facilitate waveguide propogation at the selected frequency band.

DESCRIPTION OF THE PREFERRED EMBODIMENT

Figure 1:
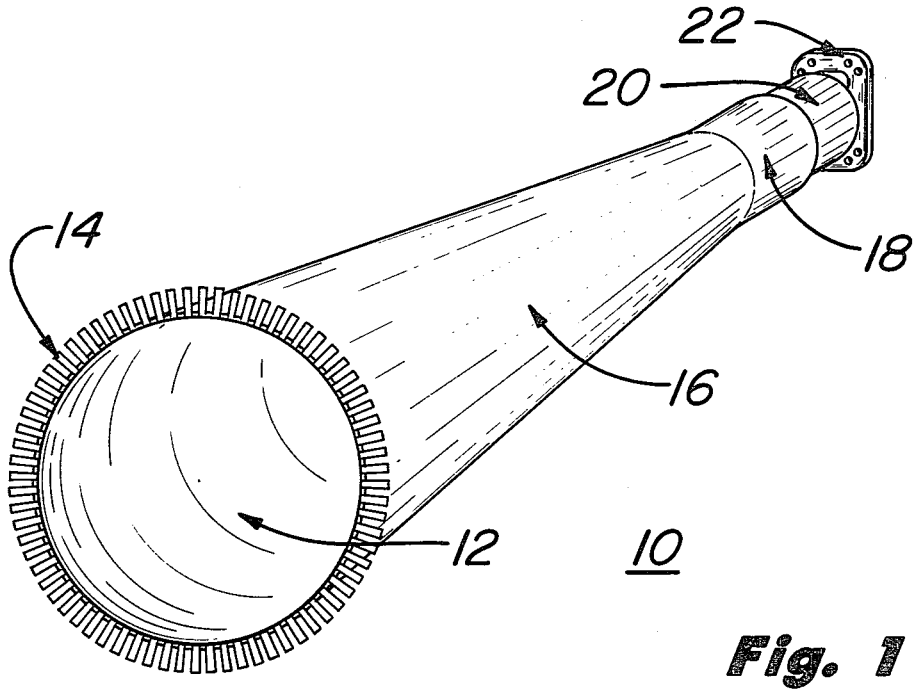
FIG. 1 is a perspective view of the preferred embodiment of a conical feed horn having a circular aperture constructed in accordance with the principles of the present invention.

Referring the FIG. 1, feed horn 10 comprises aperture 12, protuberances, also called herein aperture pins, 14 symmetrically disposed along the entire outside periphery (not shown) of aperture 12 and parallel to the plane of the aperture, conical section 16, waveguide transition section 18, impedance matching section 20 and waveguide mount 22.

Aperture 12 is constructed in accordance with well-known principles of feed horn design. See, for example, "Reference Data for Radio Engineers," Howard Sams for ITT, 6th Edition, 1979. Aperture pins 14, however, are typically one-quarter wavelength long. Thus, pins 14 must be selected for a given frequency band. In addition, while the pins may be separate elements suitably mounted to the periphery of aperture 12, they are preferably an integral part and homogeneously formed out of the same material conical section 16 is constructed. Such material may be spun aluminum sheet metal. Aperture pins 14 are suggested in "Compensated Electro-Magnetic Horns," James T. Epis, *The Microwave Jour-*

*nal,* 1961, but not in conjunction with other features of the present invention, or as specified here.

The diameter (or width) and spacing of aperture pins 14 are determined experimentally for a particular aperture configuration as indicated below. Pin spacing varies with pin diameter, which may be as much as one-tenth wavelength, however, preferably, the diameter of pins 14 are approximately 1/12 wavelength and the spacing between them is also approximately 1/12 wavelength. It is important to note that the density of pins 14 should not be substantially greater than that indicated, since, as the density increases, they form a medium for re-fringing of E-plane radiation.

Figure 3:
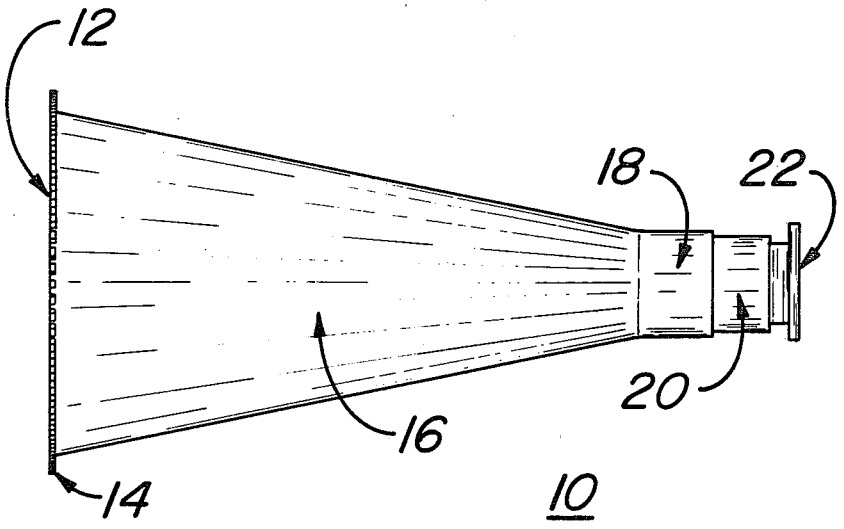
FIG. 3 is a side view of the feed horn of FIG. 1.
Figure 4:
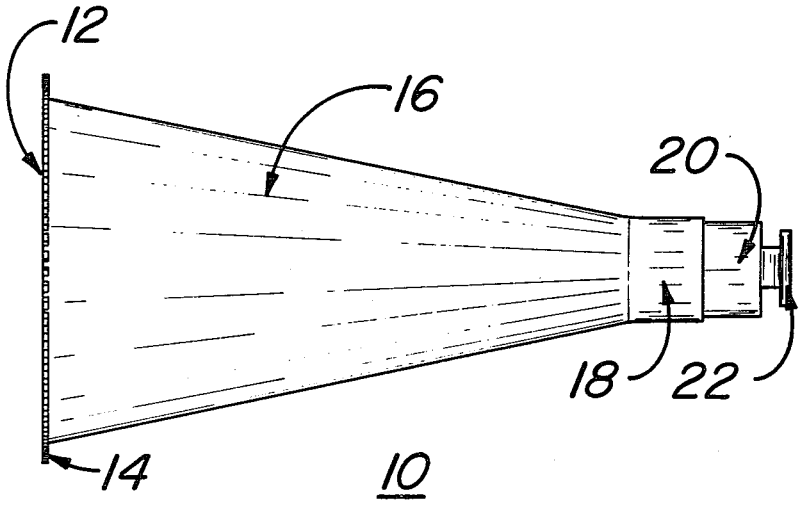
FIG. 4 is a top view of the feed horn of FIG. 1.
Figure 5:
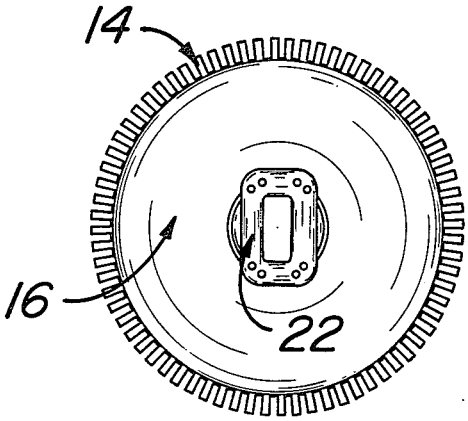
FIG. 5 is an end view of the feed horn of FIG. 1 showing the waveguide mount and outside of the conical section thereof.

Conical section 16, also shown in FIGS. 3 and 4, is designed to transmit electromagnetic energy from the waveguide system, to which the horn is connected via waveguide mount 22 and which is not part of this invention, to aperture 12 (transmit mode) and from aperture 12 to the waveguide system in the receive mode. The taper, length and other parameters of the conical section 16 are determined by reference to various standard sources in this field of art, including "Reference Data for Radio Engineers," Howard Sams for ITT, 6th Edition, 1979.

Figure 6:
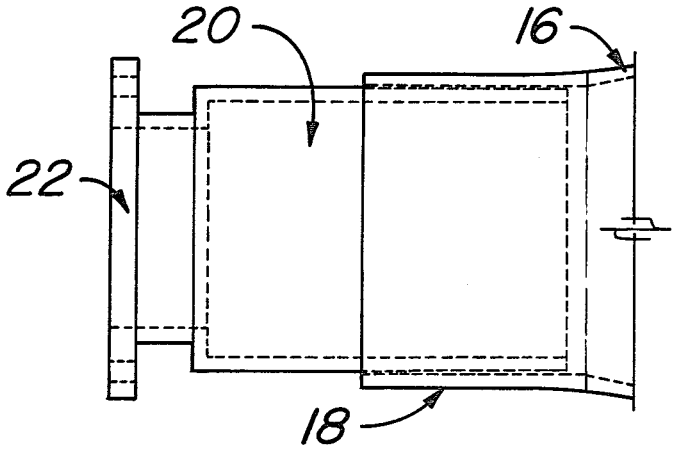
FIG. 6 is a cutaway view of the waveguide transition and impedance matching sections of the feed horn of FIG. 1.

Waveguide transition section 18 and impedance matching section 20 are shown in FIGS. 1, 3, 4 and 6. Referring to FIG. 6, waveguide transition section 18 comprises a section of circular waveguide of greater than ½ guide wavelength, but as short as possible for mechanical stability and integrity. The necessary waveguide propagation mode, also known as $TE_{11}$Mode, is only achievable in greater than ½ guide wavelength. $TE_{11}$ propagation mode must be formed in order for impedance matching section 20 to be effective.

Figure 2:
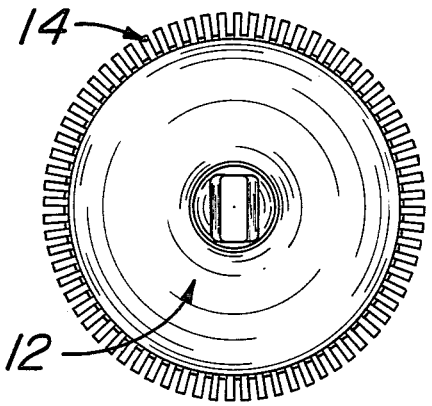
FIG. 2 is an end view of the feed horn of FIG. 1 showing the aperture and inside view of the waveguide end thereof.

Referring again to FIGS. 2 and 6, impedance matching section 20 comprises a ¼ wavelength transformer (¼ guide wavelength). This transformer presents an impedance to the signal which is the geometric mean between the circular waveguide and the rectangular waveguide impedances, wherein the rectangular waveguide impedance is selected for the particular frequency band of interest.

Waveguide mount 22 provides coupling to standard waveguide as selected by the user for a given system frequency. Mount 22 is preferably an integral part of impedance matching section 20.

The principles of the present invention are equally applicable to pyramidal feed horns having square or rectangular apertures.

The present invention provides controlled illumination of the aperture of the primary reflector in a long f/D antenna system. The E- and H-plane beamwidths are equalized to minimize noise from sources surrounding the antenna reflector. By equalizing E- and H-plane radiation beamwidths, taken with the other features of the invention, the feed horn of the present invention also makes more efficient use of the antenna reflector.

It should be noted also that the feed horn of the present invention may be used to receive circularly polarized signals. For receiving circularly polarized signals, it is preferable to add six protuberances (not shown), also called posts herein, to impedance matching section 20. The posts, mounted three on each side of impedance matching section 20, extend radially inward, diametrically opposed, along the longitudinal length thereof. The posts are less than a quarter wavelength long and spaced less than a quarter wavelength apart. They convert circularly polarized waves to linearly polarized signals for waveguide propagation by aligning the orthogonal fields of the circularly polarized signal as it propagates along impedance matching section 20.

I claim:

1. An electromagnetic feed horn for use with antenna reflectors in a waveguide transmission system, said feed horn comprising:

an aperture for receiving electromagnetic waves, including a plurality of protuberances symmetrically disposed radially outward along the periphery thereof and orthogonal to the direction of propagation of said waves;

a conical section coupled to the aperture for receiving electromagnetic signals therefrom;

a waveguide mount for mounting the feed horn to the waveguide transmission system;

an impedence matching section coupled to the waveguide mount, for matching the electromagnetic signal impedance of the feed horn to the waveguide system; and a waveguide transition section for coupling the conical section to the impedance matching section and for converting energy received from the conical section to signals propagating in a waveguide mode.

2. An electromagnetic feed horn as in claim 1 wherein the length of the protuberances are a preselected fraction of the wavelength of the frequency band of interest.

3. An electromagnetic feed horn as in claim 1 wherein the spacing of the protuberances is a preselected fraction of the wavelength of the frequency band of interest.

4. An electromagnetic feed horn as in claim 1 wherein the width of the protuberances is a preselected fraction of the wavelength of the frequency band of interest.

5. An electromagnetic feed horn as in claim 1 wherein the density of the protuberances does not exceed a preselected ratio of protuberance diameter to protuberance spacing.

6. An electromagnetic feed horn as in claim 1 wherein the length of the waveguide transition section is a preselected fraction of the waveguide of the frequency band of interest.

* * * * *